United States Patent [19]

Thomas et al.

[11] Patent Number: 5,011,147

[45] Date of Patent: Apr. 30, 1991

[54] SHUFFLEBOARD BILLIARDS

[76] Inventors: Dale A. Thomas; Adeline M. Thomas, both of 342 Spruce St., Dickinson, N. Dak. 58601

[21] Appl. No.: 423,622

[22] Filed: Oct. 18, 1989

Related U.S. Application Data

[63] Continuation of Ser. No. 141,330, Jan. 5, 1988, abandoned.

[51] Int. Cl.[5] ..... A63B 71/00

[52] U.S. Cl. ..... 273/126 A

[58] Field of Search ..... 273/85 R, 5 A, 5 B, 273/3 R, 8, 121 R, 126 R, 108, 119 R, 121 A, 122 R, 123 R, 123 A, 124 R, 124 A, 126 A

[56] References Cited

U.S. PATENT DOCUMENTS

| | | | |
|---|---|---|---|
| 1,099,419 | 6/1914 | Beatty | 273/126 |
| 1,550,517 | 8/1915 | Hawks | 273/9 |
| 1,599,188 | 9/1926 | Seeds | 273/119 R |
| 1,945,798 | 2/1934 | Barry | 273/121 R |
| 2,467,043 | 4/1949 | Kotler | 273/128 |
| 2,472,884 | 6/1949 | Colaluca | 273/136 |
| 2,522,275 | 9/1950 | Keegan et al. | 273/39 |
| 2,565,238 | 8/1951 | Koci | 273/126 |
| 2,593,641 | 4/1952 | Wolverton | 273/126 |
| 2,695,174 | 11/1954 | Cuasano | 273/128 |
| 2,704,211 | 3/1955 | Decepoli | 273/128 |
| 2,811,359 | 10/1957 | Haufe | 273/130 |
| 2,878,023 | 3/1959 | Decepoli | 273/128 |
| 2,923,546 | 2/1960 | Santiago | 273/9 |
| 2,990,180 | 6/1961 | Koci | 273/126 |
| 3,174,752 | 3/1965 | Plentis | 273/126 |
| 3,219,349 | 11/1965 | Smith | 273/126 |
| 3,228,688 | 1/1966 | Dennison | 273/85 |
| 3,232,619 | 2/1966 | Burk | 273/123 |
| 3,489,410 | 1/1970 | Stillman, Jr. et al. | 273/9 |
| 3,533,626 | 10/1970 | Smith | 273/26 R |
| 3,647,215 | 3/1972 | Sterlicchi et al. | 273/126 R |
| 3,762,711 | 10/1973 | Cooper | 273/126 |
| 3,817,519 | 6/1974 | Leonhart | 273/30 |
| 3,907,294 | 9/1975 | Breslow | 273/85 |
| 4,000,900 | 1/1977 | Lehmann | 273/126 |
| 4,017,078 | 4/1977 | Goldfarb et al. | 273/26 R |
| 4,215,863 | 8/1980 | Kniper | 273/126 |
| 4,502,686 | 3/1985 | Iiams, Jr. | 273/126 |

FOREIGN PATENT DOCUMENTS

| | | | |
|---|---|---|---|
| 2224927 | 12/1973 | Fed. Rep. of Germany | 273/126 R |

OTHER PUBLICATIONS

Washington Post, Nov. 26, 1971, p. A-13.

*Primary Examiner*—Theatrice Brown
*Attorney, Agent, or Firm*—Kinney & Lange

[57] ABSTRACT

A table shuffleboard has a rectangular table top with a divider rail down the center of the table separating the top into two playing courts along a substantial length of the tabletop. A crossover opening at a remote end from the players is provided to enable a sliding game piece or puck to be passed from one court to another, so that players can slide the puck and bank the puck against cushions from one court to the other for scoring during playing a game. The center divider rail includes cushions along its length for rebounding a puck, and the scoring areas are arranged to take into account the skill needed for banking shots in order to obtain high scores. A gate pin blocking arrangement is provided to prevent play when the device is used as a coin operated game.

13 Claims, 11 Drawing Sheets

198
150
165
193
189
195
191
192
170
194
190
184
163
183
183A
162
180
177
179
155
177A
178
181
185
153B
161
156
165
164
188
154
152
153
153A
151
152
152B
31
30
33

169
176
170
171
16
171

176
170
175
171

14
30
153
14
173
170
170
33
30
175
176
163

163
209
210
198
199
195
193
LATCHING RELAY
190
184
A.C. SOLENOID
185
D.C. SOLENOID
228
SPEAKER
227
ALARM
226
225A
225
224A
224
236
110V. A.C.
235
238
239
222
221
266
110V. A.C.
204
COIN INPUT BOX
205
COIN COUNTER
207
START GAME BUTTON
240
12 VOLT CHARGER
110V. A.C.
12 VOLT BATTERY
223
242
KEY OPERATED SWITCH
10 MINUTE TIMER SWITCH
219A
219
219B
15 MINUTE TIMER SWITCH
220A
220
220B
15 POINT GAME SWITCH
212
212A
212B
21 POINT GAME SWITCH
213A
213
213B

SHUFFLEBOARD BILLIARDS

This is a continuation of U.S. application Ser. No. 07/141,330 filed on Jan. 5, 1988, abandoned as of the date of this application.

BACKGROUND OF THE INVENTION

1. Field of the Invention.

The present invention relates to table games wherein a projectile is slid along a table surface and rebounded toward a scoring area.

2. Description of the Prior Art.

A portable shuffleboard game is shown in U.S. Pat. No. 3,762,711. This patent discloses a device that has a game board with a center divider, and projectiles that are manually slid along the table board from one side of the divider to another for scoring. The projectiles are roller operated or based, and rubber band type rebounding members are utilized.

U.S. Pat. No. 3,907,294 also shows a competitive projectile game with a rebounding ball, and a table top that has a short divider that divides a short portion of the table top into two court areas.

U.S. Pat. No. 3,174,752 shows a game apparatus that has a divided game board for shuffleboard playing, and has cushions, including rebound cushions on a short center divider. These however are cushions which are resilient rings that are glued or fastened in place, to form bumpers for play.

U.S. Pat. No. 4,502,686 shows a symmetrical folded alley game board with a pair of dividers, and rebound members so that there are three alleys formed, and a central alley has a target area therein. A projectile that comprises a roller mounted in an outer housing is used for the playing piece.

U.S. Pat. No. 3,219,349 shows a shuffleboard game with a central divider so that the base portion where the players stand is formed into two separate alleys. U.S. Pat. No. 2,990,180 also shows a game board with a central divider, and this particular device has a coin operated system which blocks the rebounding members at one end of the game board when the game is over, after a preselected length of time.

Game devices that have projectiles that are rebounded on wall cushions, have also been known, and such devices are shown in U.S. Pat. Nos. 3,232,619, 2,472,884 and 1,099,419. However, these devices do not show a cushioned center divider for example, and show a different cushioning arrangement than that disclosed herein.

Gate pins that are used for blocking movement of pucks or projectiles are shown in U.S. Pat. Nos. 2,565,238 and 3,817,519. These patents show different structures for obtaining the results of extending pins for forming barriers to prevent play in coin operated machines. After the clock or time has run out the pins will protrude and prevent further play.

Additionally, U.S. Pat. No. 2,593,641 shows a puck obstructing device for a shuffleboard game which comprises pins that are raised up to prevent play and which are operated by a solenoid.

U.S. Pat. No. 3,228,688 also shows a game board that has a barrier that is raised up to prevent game play when desired.

U.S. Pat. No. 4,215,863 shows a sliding puck game wherein a cover member controls barriers or pegs that project into the path of the puck to prevent play at selected times.

Various puck or sliding weights are also known in the prior art, and patents which show such pucks include U.S. Pat. Nos. 4,000,900; 2,878,023; 2,467,043; 2,695,174; and 2,704,211.

The puck of the present invention utilizes a heavy base, with a plastic top that is dome-shaped so that it feels much like a billiard ball, and provides a feel for banking and putting spin on the billiard puck as it is slid.

U.S. Pat. Nos. 2,522,275 and 2,811,359 show game apparatuses of general interest.

Additionally, there are games which are marketed that use single length shuffleboards, and some with short dividers, but none which combine to provide for the simplicity of construction, ease of replacing rebound cushions, easily operated pucks, and the rectangular relatively short table that can be easily stored and used in compact places, and yet which provides the excitement of a full-scale game.

SUMMARY OF THE INVENTION

The present invention relates to a shuffleboard-type game utilizing a billiard ball-shaped puck or playing piece, and wherein the game is played on a rectangular table that has peripheral side and end walls and a divider dividing the table into two side-by-side courts. Each court is used by both players, and each court has a scoring area defined at one end of the table. The divider extends along the central bisecting line of the table and terminates spaced from the opposite end from the scoring areas. The divider and the side and end walls are provided with rebound cushions so that the playing piece can be propelled by a player on one side of the divider to rebound into the court on the other side of the divider across the open space at the opposite end of the table which is left open, and then come to rest on a scoring area. A unique layout of the playing and scoring area is provided, and unique removable cushion members are provided for easy replacement. The unit can be made as a coin operated unit and includes gate pins that can be extended to prevent play whenever a preselected length of playing time has expired or when other conditions occur.

The gate pin operating structure and timer assembly is uniquely suited for use with coin operated machines.

The puck that is used also is made in a two-piece construction utilizng a heavy disc at the bottom which slides on the table top, and a part-spherical or half billiard ball for the top gripping region, so that it fits into the hand easily and can be slid accurately and with a desired amount of spin or English placed on the puck.

The playing surface is on a sheet of high impact, clear plastic which has a matte finish to eliminate light reflections. The surface on the underside of the sheet is painted a billiard cloth green and the scoring area is silk-screened in place on the bottom, protected side.

The game board and pucks gives the feel and excitement of true shuffleboard, as well as combining the features of banking or cushion shots of billiards.

DETAILED DESCRIPTION OF THE PREFERRED EMBODIMENTS

Figure 1:
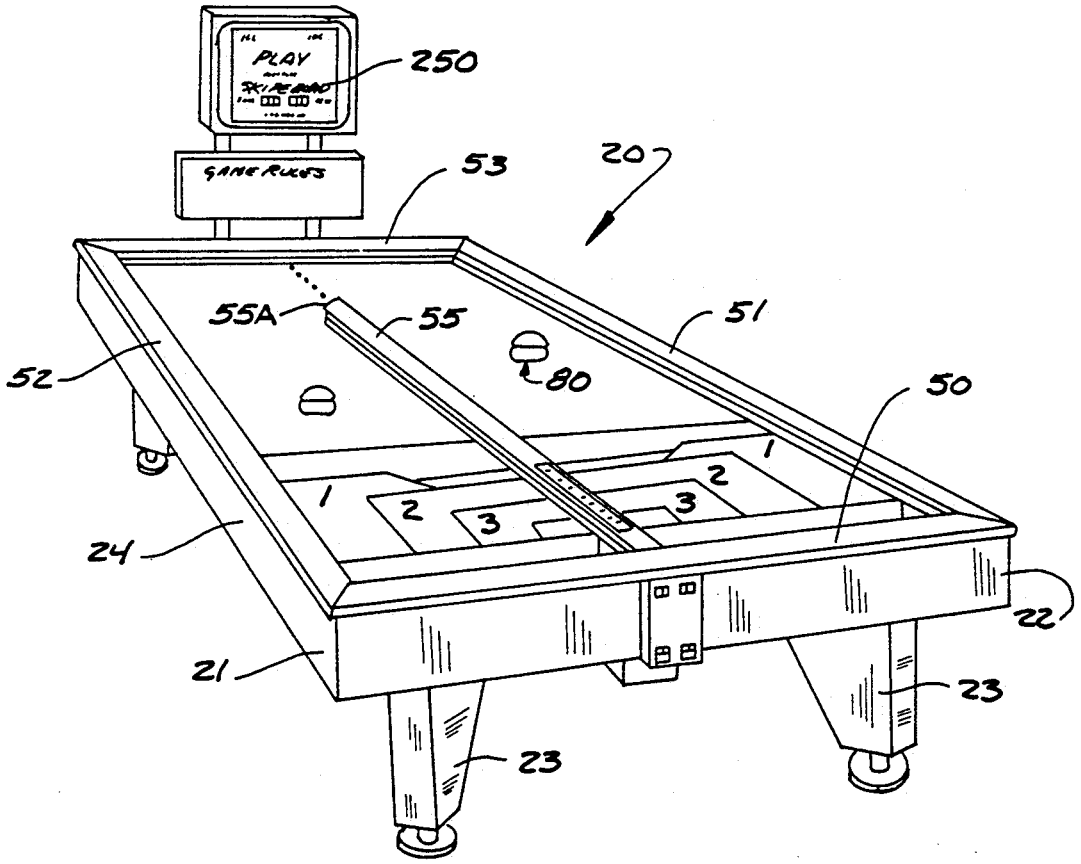
FIG. 1 is a perspective view of the shuffleboard billiard table made according to the present invention.
Figure 5:
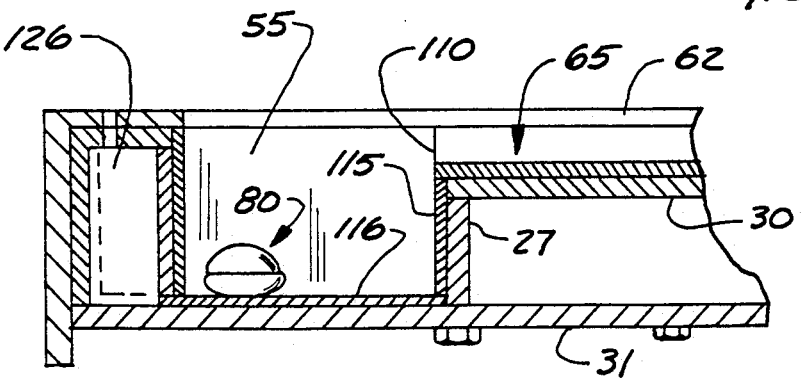
FIG. 5 is a fragmentary sectional view showing a puck pit area taken generally along 5—5 in FIG. 2.
Figure 7:
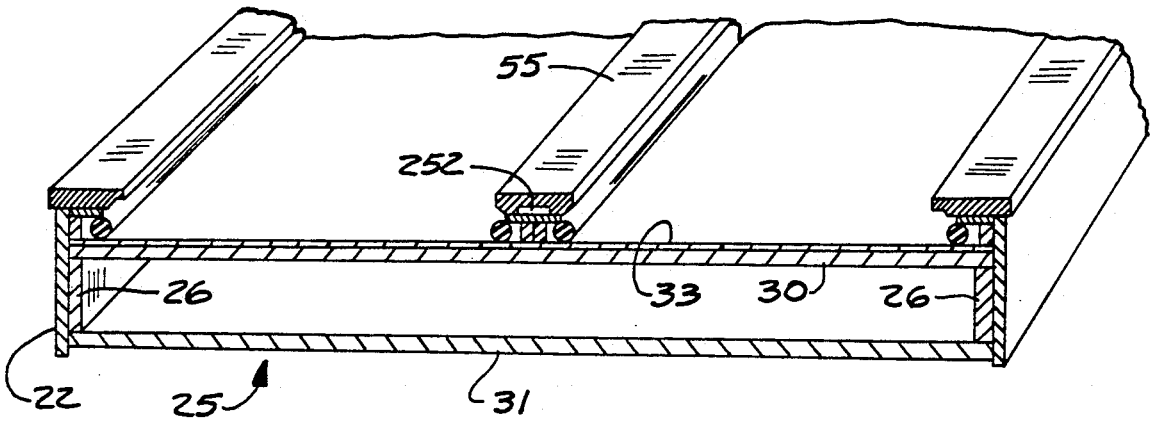
FIG. 7 is a perspective view of the table of the present invention taken from the same end as FIG. 6 with parts in section to show the mounting of rebounding cushions or rails.
Figure 8:
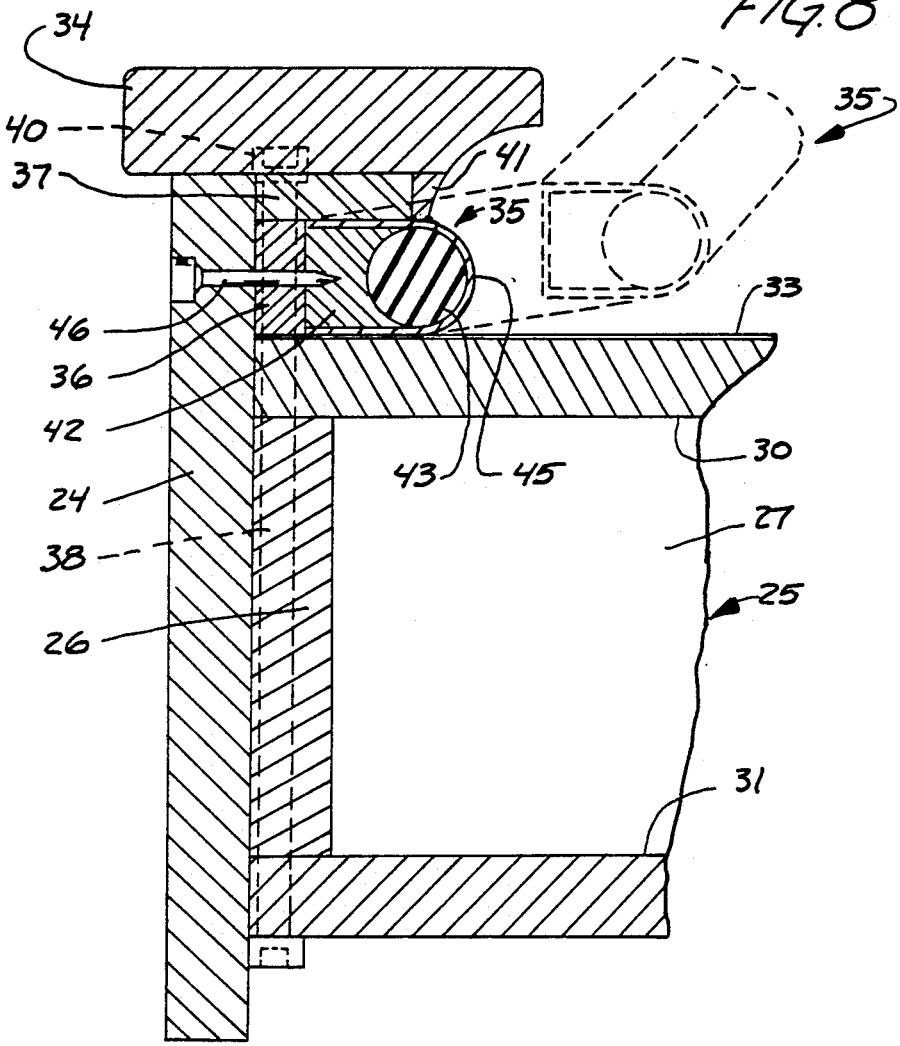
FIG. 8 is an enlarged sectional view of a typical rebounding cushion or rail along the side of the table.

A shuffleboard billiard game indicated generally at 20 comprises a table 21 that has a main outer frame 22, supported on legs 23, at each of the corners in a normal manner The frame 22 can be made up in any suitable manner, but includes outer facia boards 24. As can be seen in FIGS. 5, 7 and 8 for example, frame 22 includes an interior frame portion 25 that has longitudinally extending stringers or frame members 26, and a plurality of spaced across spaced apart cross members 27. The longitudinal members 26 and the cross members 27 are used to support and join a table top panel 30, and a table bottom panel 31 that are spaced apart as shown. The outer facia boards 24 comprise boards with extra height over that of the interior frame 25, and the facia boards 24 extend up above the table top panel 30. It should be noted that the table top panel 30 has a durable clear plastic top sheet 33 thereon, on which the scoring areas are silk-screened, and which can have a suitable finish on its bottom side, that is, the side adjacent the panel 30, which is visible from the top surface which is shown in FIG. 1.

The upper portions of the facia boards 24, at both the sides and ends of the table 21 extend up above the surface of the plastic top sheet 33, and a top cap 34 is placed thereon. The boards 24 provide backing for bumper rail assemblies 35, which are shown perhaps best in FIG. 8. The bumper rail assembly 35 is supported in a receptacle defined by a backing board 36 adjacent the respective facia board 24, and a cover board 37 that is positioned below the top cap 34. The cover 37 and backing board 36 are held together with suitable cap screws or bolts 38 that extends upwardly from the bottom frame panel 31, all the way up into the cap 34, where the cap screws are anchored in a nut or fastener 40. A molding 41 is provided at the outer end of the cover 37 for decorative purposes. The receptacle that is formed by the top of the plastic sheet and the cover board receives the bumper assembly 35. The construction shown is the typical construction for both the sides and the ends of the table.

Bumper assembly 35 includes an elongated mounting block 42 and a rebounding cushion 43 that is made of a suitable material such as some type of an elastomeric material. Cushion 43 can be glued or otherwise fastened onto the mounting block 42 to form an assembly and then the assembly can be covered with a flexible decorative material such as a suitable cloth indicated at 45. The cloth material 45 can be wrapped around the back side of the mounting block 42 to hold the cushion in place, and to make a decorative appearance. The bumper assembly 35 can be slid from its dotted line portion shown in FIG. 8 into the receptacle below the cover 37 to a position against the spacer block 36, and held in place with a suitable screw 46 passing through the outer decorative facia board 24 at both the sides and the ends of the table.

The assembly 35 can easily be replaced by releasing the screws 46 from the block 42, and putting in a new one, as desired, as is shown in dotted lines in FIG. 8.

The bumper or cushion assemblies 35 extend all the way around the table, at both the ends and the sides.

For example, in FIG. 1 the player end is indicated at 50, and there are sides 51, 52, as well as a remote end 53 on the table.

Figure 2:
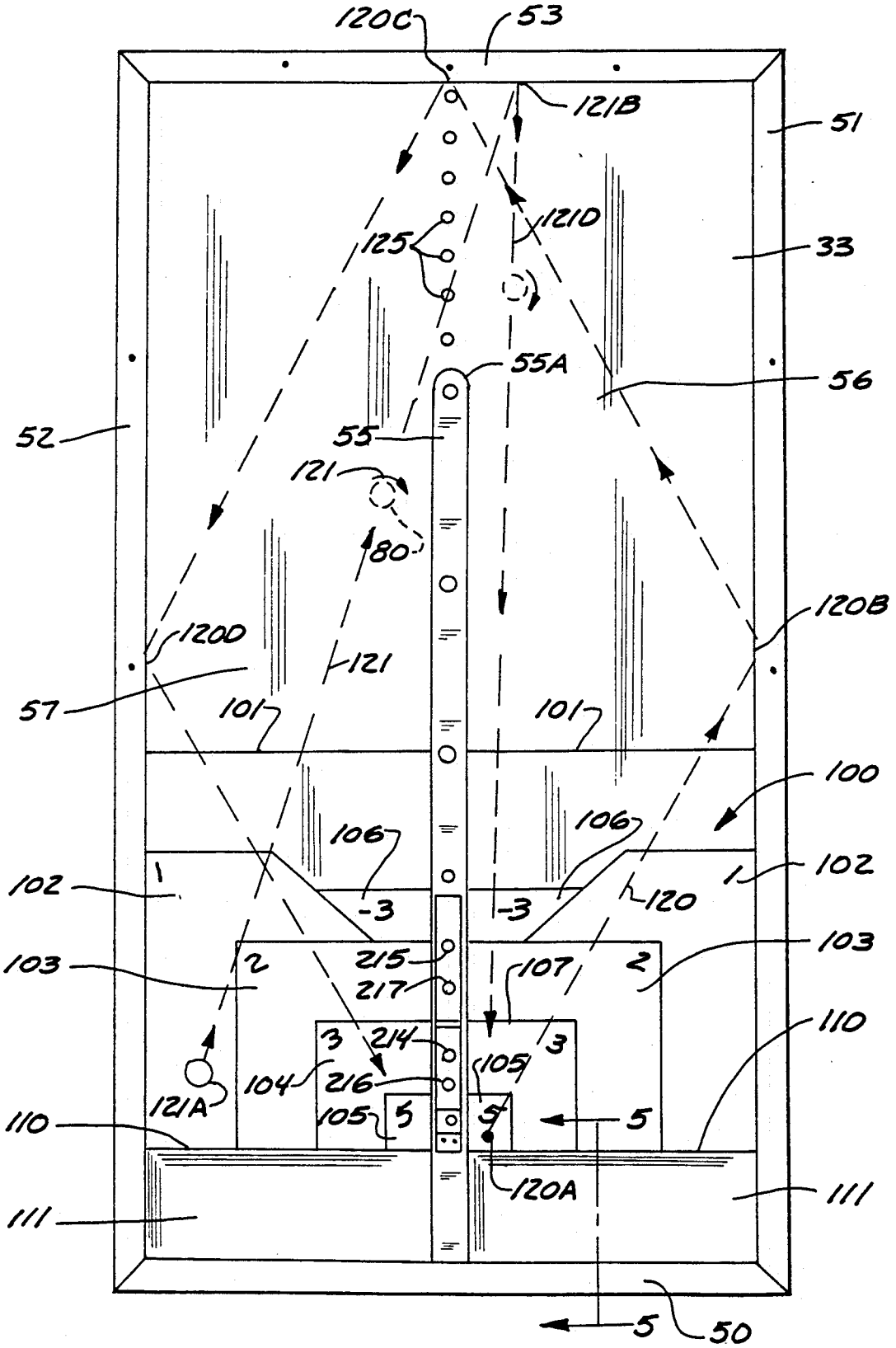
FIG. 2 is a top plan view of the table surface of FIG. 1 with parts in section and parts broken away.
Figure 3:
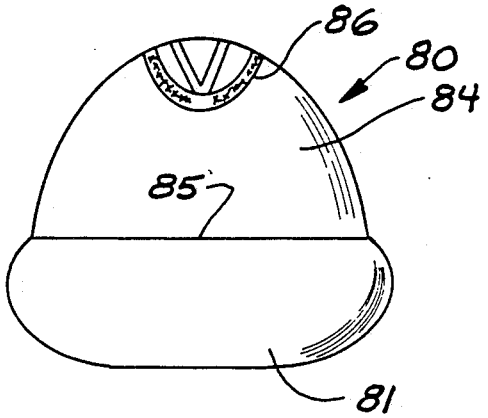
FIG. 3 is a side elevational view of a typical puck or playing piece used with the present invention.

The playing surface of the table top is divided longitudinally with a divider indicated generally at 55 in FIGS. 1 and 2, for example. This divider 55 is a narrow raised rib-type member that commences at the player end 50 and that terminates at a rounded end 55A, spaced from the remote end 53 of the table. The divider 55 therefore divides the table into two playing surfaces 56 and 57, respectively. The courts are connected at the space between the end 55A of the divider and the remote end of the table.

Figure 9:
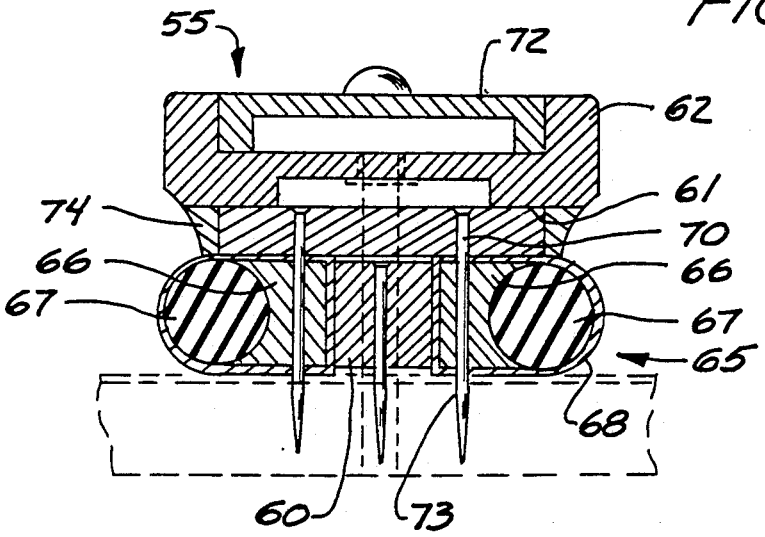
FIG. 9 is a sectional view across the center divider, again showing the details of the rebounding rail.

The divider 55, as shown in FIG. 9 for example, is mounted on the table top through a support block 60, a retainer plate 61, and a cover plate 62 that overlies the retainer plate. The support block 60 supports the retainer plate 61 which extends outwardly on opposite sides of the support block 60 to form two receptacles into which bumper or cushion assemblies 65 can be mounted. The cushion assemblies 65 are made similar to the cushion assemblies 35, and as shown include a longitudinally extending backing block 66, and a cushion member 67 that is covered with a flexible outer covering 68. The backing blocks 66 on the opposite sides of the support block 60 are held in place with suitable screws 70, which thread down into the table top panel 30, and which are accessible from the top side upon removal of the cover plate 62, which is held in place with suitable cap screws coming up from the table bottom panel. Screws 73 hold the center block 60 in place.

An electric circuit housing 72 is provided in a recess formed in cover plate 62 and is used for housing the controls and indicators for scoring and game operation.

Decorative filler strips 74 are provided immediately above the cushions 67, and which close the edges of the retainer plate 61.

The bumper or rebound cushions extend around the rounded end portion 55A of the divider member 55 as well as along the sides thereof and are in position so that they will serve to rebound a playing piece or puck member shown generally at 80. The puck member 80 includes a heavy disc-like base 81, which has a curved or rounded outer edge surface 82, and a flat bottom surface 83 so that it will slide easily along the table top. The puck base 81 curves inwardly toward its center at the top of the curved surface 82. A part-spherical hand grip shaped as a "half-ball" 84 is fixed to the top of the heavy disc for easy gripping, and for making the unit attractive and streamlined. The half-ball 84 (which can be slightly more than half a sphere) curves inwardly slightly where it joins with the disc 81 along a junction line 85. At the upper side of the hand grip a logo trademark, or identification label indicated at 86 can be provided.

Figure 4:
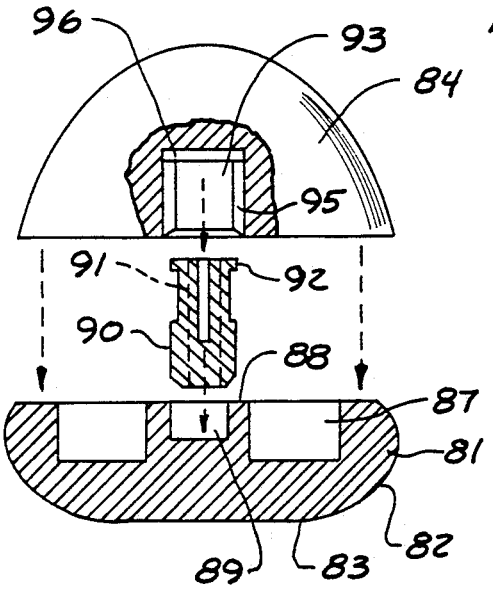
FIG. 4 is an exploded view of the device of FIG. 3 showing the internal construction, with parts in section and parts broken away.

The disc base 81 is made of a metal and may be chrome plated or otherwise finished. The upper portion or half-ball hand grip portion 84 is preferably made of a suitable plastic. FIG. 4 illustrates the parts in exploded view to illustrate how the parts are fastened together. The disc 81 has an annular recess 87 therein that surrounds a central boss 88. The central boss 88 has a bore 89 in its center portions which is of size to receive a sleeve 90. The sleeve 90 is press-fitted or adhesively fixed in the bore 89 so that the sleeve is secured to the base 81. The upper portions of the sleeve 90 are split so that resilient fingers 91 are formed. A narrow flange 92 is provided at the outer ends of the fingers. The fingers 91 and flanges 92 compress inwardly to fit within a receptacle 93 in the hand grip ball member 84, and when assembled the flange fingers 92 will slide in along the inner surfaces of radially extending ribs 95, and latch into a recess 96 at the top edge of the ribs 95 so that the two parts are held securely together. A pry tool that has tapered, bifurcated fingers that will slip in along the junction line 85 can be used for taking the top hand grip ball 84 off the base 81 if the grip ball 84 is to be replaced. The pucks can be repaired, but when assembled they are very solid and properly weighted for playing the rebounding shuffleboard game of the present invention.

The lower disc member 81 can be chrome plated, while the top ball hand grip portions 84 are preferably colored different colors, for example one would be yellow and another black, which would represent a No. 1 billiard ball and a No. 8 billiard ball.

Referring specifically to FIG. 2, a layout of the game playing surface is shown. As stated, the table top panel 33 has a pattern silk-screened on its underside, which is supported on the panel 34. The table top is divided into two courts 56 and 57. The base or player ends of the courts, which are adjacent base end 50 of the table, have scoring patterns indicated generally at 100 thereon. Scoring patterns 100 on each of the courts 56 and 57 are mirror images of the other, and so the same numerals will be used for identification. Foul lines 101 are provided part way up on each of the courts and the scoring areas are spaced from the foul line back toward the base end 50 a selected amount. The points scored are indicated in FIG. 2, and include a one-point scoring area 102, a two-point scoring area 103, a three-point scoring area 104, and a five-point scoring area 105. As can be seen, the lower scoring areas are out near the side rails 51 and 52, and extend over laterally toward the center A negative three-point scoring area 106 is provided at each of the scoring areas 100 adjacent to the side of the divider and between one end of the "L"-shaped one-point scoring area and the divider The two-point scoring areas 103 are formed by "L"-shaped strips that have one section parallel to the sides of the table and a second right-angle section that is parallel to the table end. The two-point scoring areas are bounded on the outside by the respective minus three scoring area and the one-point scoring area. Each three-point scoring area is shaped similarly to the two-point scoring area and bounds the inner sides of the two-point scoring areas. Each three-point scoring area is positioned closer in toward both the base end 50 and the center divider 55 than the two-point scoring area and is bounded on its inner sides by the five-point scoring area 105. Each five-point area is a rectangular block bordering on the edge line 110 of a puck pit 111 and one side of the central divider 55A.

The puck pit 111 is shown in cross-section in FIG. 5, and it can be seen that the edge 110 is along the top of a vertical wall 115. The puck pit 111 is a dropoff point for pucks. There is no score for falling into the puck pit. The wall 115, as well as the bottom wall 116 of the puck pit, and also the rear walls are provided with a padded covering for noise reduction.

The players stand adjacent to the base end 50, and then slide the pucks from a selected starting point without passing the foul line with the hand still on the puck. The puck is released and slid along the table putting on whatever type of spin or english desired. A typical sliding shot path is shown in FIG. 2 at 120, starting at the point 120A, and rebounding at approximately 120B, on the cushion 43 along table side 51, and then rebounding on an end cushion 43 at approximately point 120C, to travel back as indicated by the arrows to point 120D and rebounding to travel toward the scoring area 105 in the court 57.

The surface of the table top 33 is polished so that it is smooth and very slippery, and the skill of the player can determine how the puck travels. For example, by applying proper spin, the puck can be started at the point shown at 121A (in court 57) to slide along a path 121 to rebound at a point 121B. The spin is indicated by the arrow 121C along path 121, where a dotted representation of a puck 80 is shown. The spin will provide for a banked return that is along the line segment 121D, so that the puck will travel toward the five-point scoring area in the court 56.

Thus, straight cushion shots and spin controlled shots can be used as desired, and the skill of the player can be exercised to achieve the proper banks for scoring. If the propelling force that is used is too great, then the puck will end up in the puck pit 111. If the puck lands in the no scoring zone, then of course no score is registered. If one crosses the foul line 101 when starting the puck, then there is generally a penalty or deduction.

The player can have three-cushion banks as has been illustrated, or a single-cushion bank, also as illustrated, as well as four-cushion banks by banking it off the center divider 55 in a pattern that provides moving the puck onto one of the scoring areas.

The game is set up for coin operation, and as shown in FIG. 2, there are a series of aperatures or openings indicated at 125 in the table top between the end 55A of the divider 55 and the end 53 of the table. The apertures are provided for raising gate pins to prevent the pucks from going from one court to another between the end 55A of the divider 55 and the remote rebound divider on table end 53.

Figure 6:
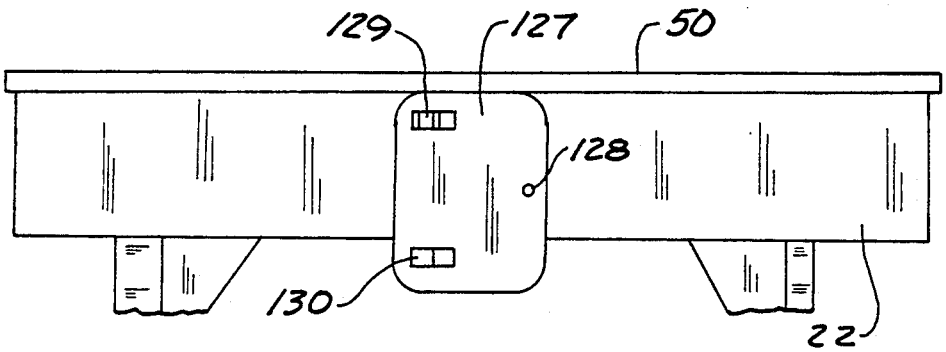
FIG. 6 is an end view of the table of FIG. 1 taken from the playing end thereof.

With coin operation as shown in FIG. 6, the table is provided with a coin box 126 at the end 55. Reference is made to FIG. 6, wherein a heavy cover plate 127 is provided with a key lock 128 for security. A coin slot 129 is provided, and a coin return 130 is provided in a normal manner, and any suitable-type coin identification means can be utilized for activating circuitry.

Figure 16:
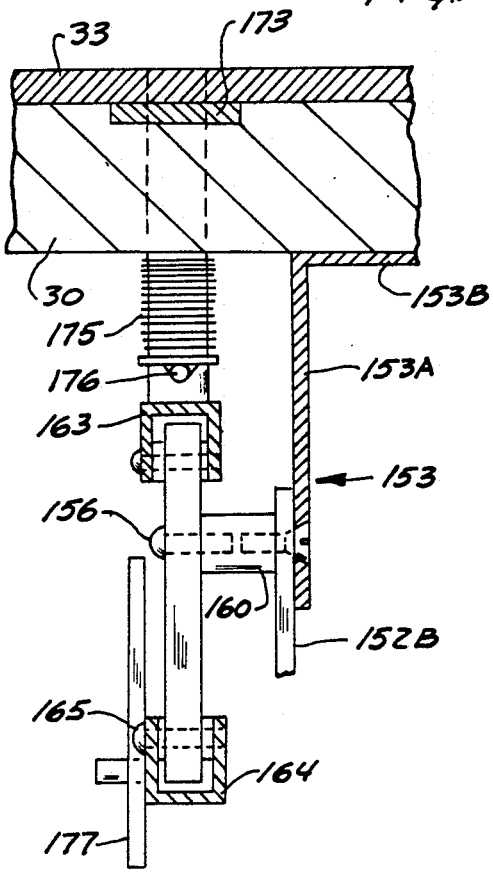
FIG. 16 is a sectional view taken as on the same line as FIG. 14, with the pins in a retracted position.
Figure 17:
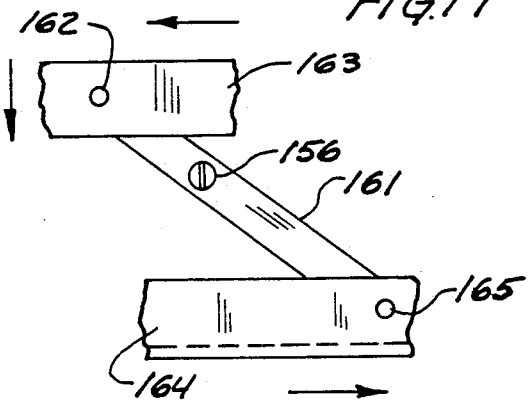
FIG. 17 is a view similar to FIG. 15 showing the actuator assembly with the pins in retracted position.
Figure 18:
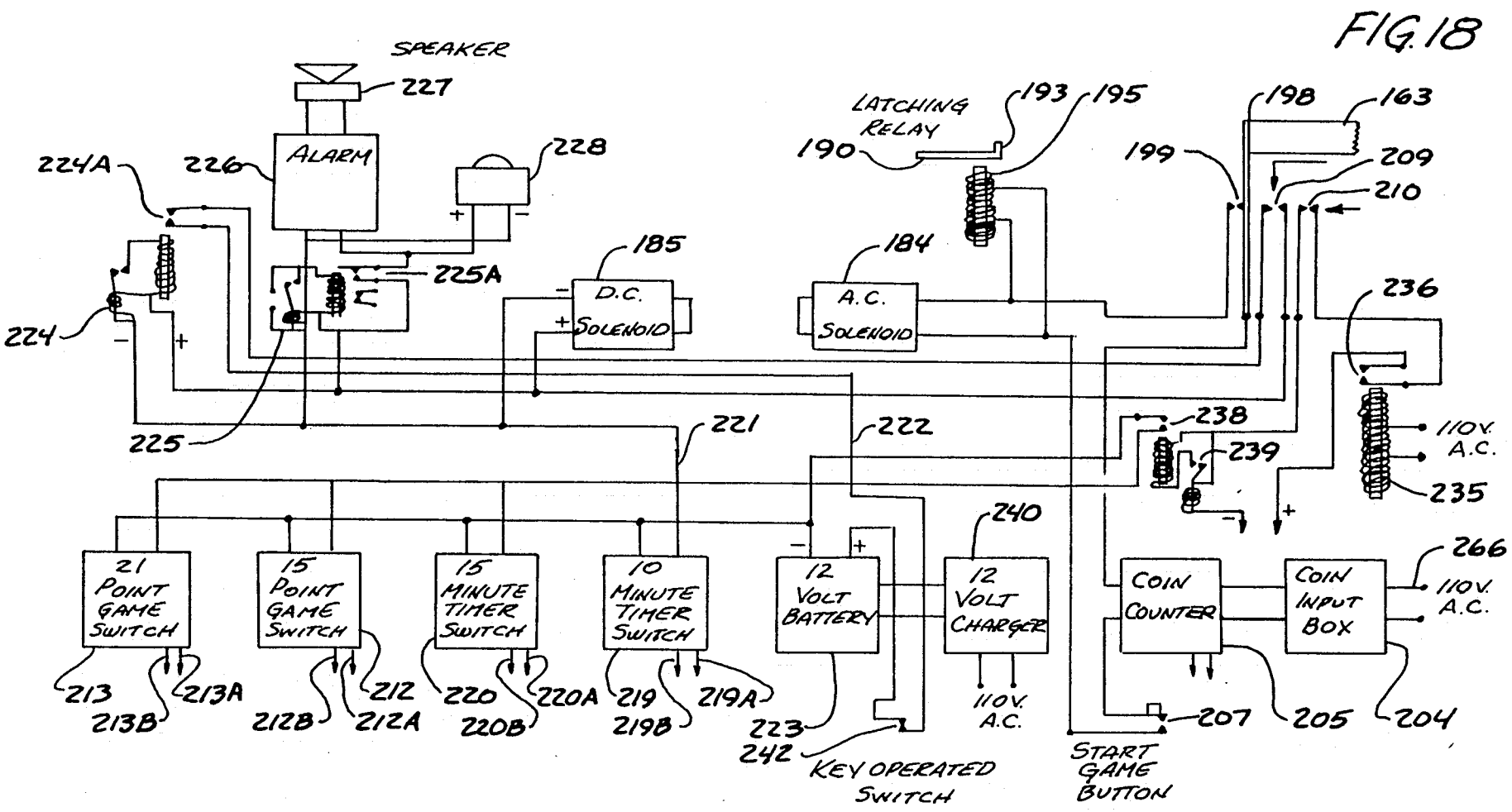
FIG. 18 is a schematic representation of a typical timing and gate pin actuating circuit.

The gate pins utilized in a first form of the invention are shown in FIGS. 10-17, and the circuitry utilized for the pins is shown in FIG. 18. In referring to the orientation of the gate pins shown in FIG. 2, it can be seen that the axes of the pins lie along a plane that bisects the divider 55, and then, referring to FIG. 10, the gate pin support and actuating assembly is indicated generally at 150. The top table panel 30 and the plastic overlay panel 33 are shown schematically, and the lower table panel 31 is also shown in place.

The assembly 150 includes a support frame 151 that comprises two adjustably mounted angle iron brackets. A first angle iron 152 has a base leg 152A that bolts or otherwise is secured to the bottom panel 31 of the table, and a second angle iron 153 has a leg 153A that mates with a leg 152B of the angle iron 152. The legs 153A and 152B are adjustably connected together with suitable fasteners 154 that operate in slots on the two legs 153A and 152B. The fasteners clamp the legs together so that an upper or base leg 153A of the angle iron 153 is in position to be screwed into the upper table panel 30 through slots 155.

Figure 14:
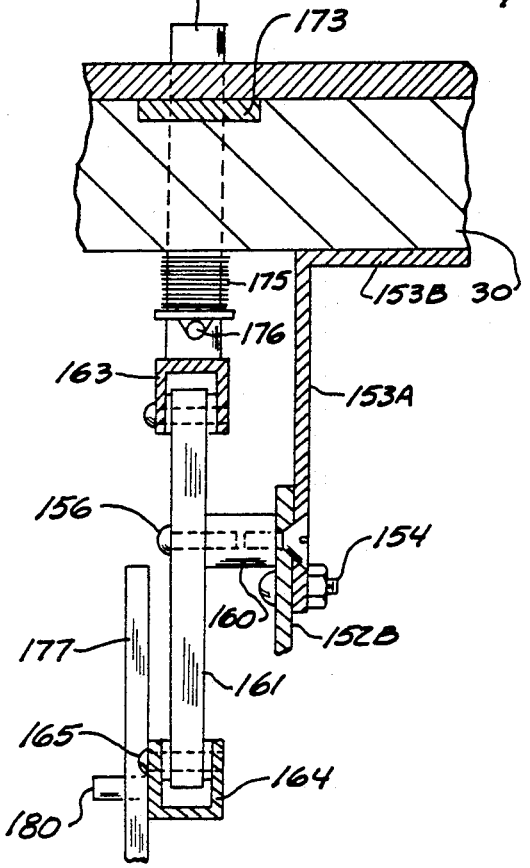
FIG. 14 is a sectional view taken as on line 14—14 in FIG. 13.

The gate pins are supported on a support channel 163 of a slide which is actuated by pivoting arms 161, through pivot pins 156 that are spaced along and are mounted on the leg 152B of the angle iron 152, as can perhaps best be seen in FIGS. 14 and 16. The pivot pins 156 are mounted onto pivot sleeves 160 that are fixed in turn to the leg 152B, and the pivot pins pass through the center portion of pivoting arms 161. As shown, there are three pivoting arms 161 used for supporting and actuating the gate pin assemblies. The arms 161 have first ends that are pivotally connected with suitable pins 162 to the gate pin support channel slide 163. The gate pin support channel slide 163, as shown, has a pair of legs that are spaced apart and the ends of the arms 161 fit between the legs of the channel slide 163 and are pivoted thereto with the pins 162. The opposite ends of the arms 161 are coupled to a channel 164, and again the arms 161 pass between the legs of the channel 164 and are pivoted thereto with suitable pins 165.

Figure 10:
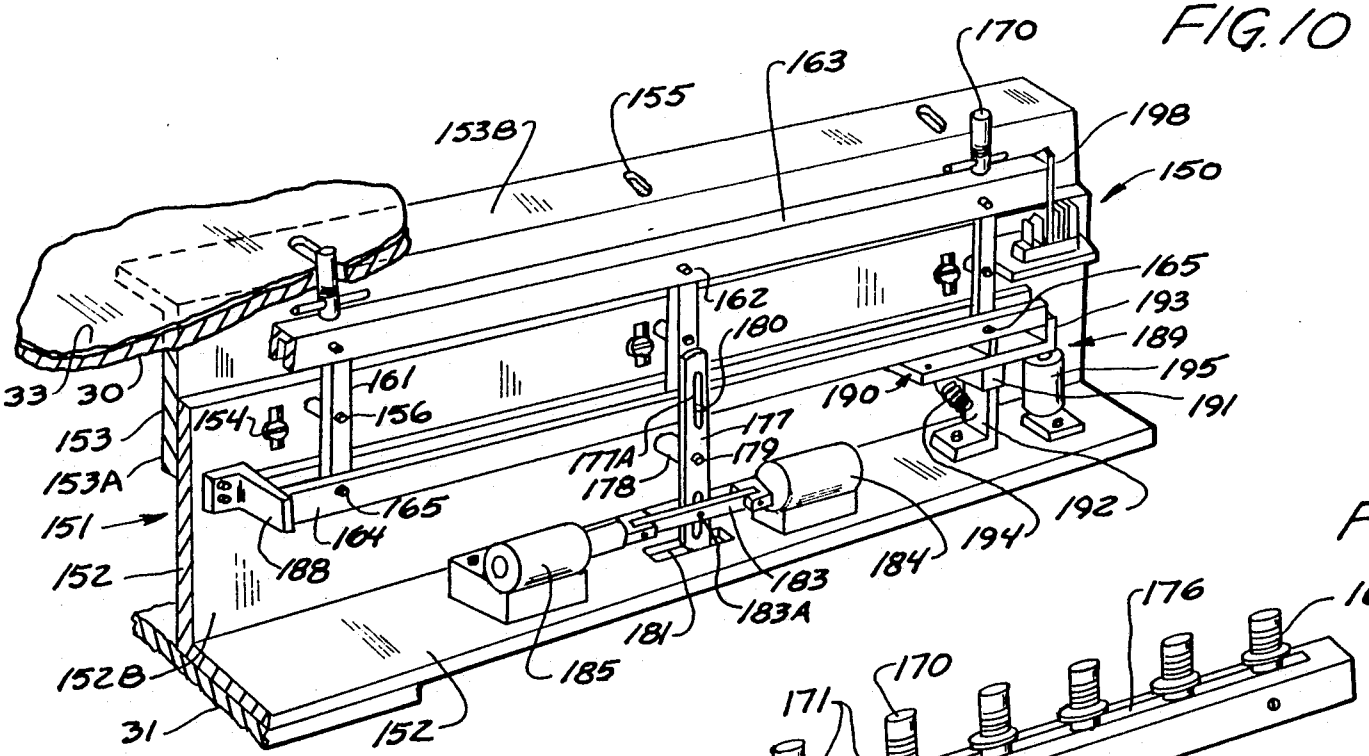
FIG. 10 is a perspective view of a first form of a gate pin actuating assembly used with the device of the present invention.
Figure 15:
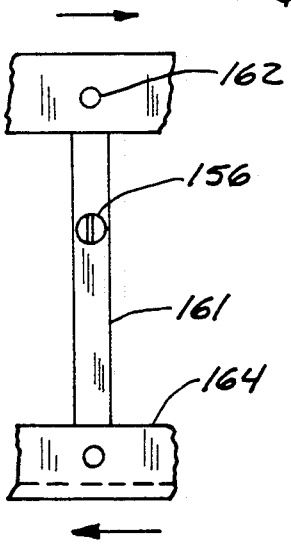
FIG. 15 is a fragmentary view of the actuator assembly with the pins in the position shown in FIG. 14.

It can be seen that when the arms 161 are moved from the position shown in FIG. 15, which is the raised position shown in FIG. 10, to the position shown in FIG. 17 by pivoting on the pivot pins 156, the elevation of the upper surface of the channel slide 163 changes relative to the table top panel 30, and since the pivot pins 156 are fixed relative to the table top panel 30, the gate pins then will change in elevation relative to the top table top panel 30.

Figure 12:
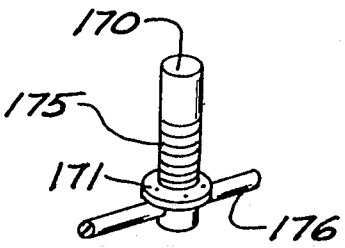
FIG. 12 is a perspective view of an individual gate pin showing its mounting arrangement.

The gate pins are indicated at 170, and they are mounted in a pin assembly 169 that comprises seven pins 170 as shown, mounted onto a cross rod or tie rod 176 that passes through each of the pins 170 as perhaps is best seen in FIG. 12. The lower or base ends of the pins 170 are slidably mounted on the channel upper surface and the upper portion of the pins are guided through provided holes in the top table panel 30, and within openings in a steel guide bar 173 which prevents wear or elongating of the holes through the wooden table panel 30, as well as through the plastic top panel 33 of the table. The pins 170 are held in place by the guide openings in the bar 173 and by the slidable interface on channel slide 163.

The pins can slide relative to the channel 163 as the channel moves up and down when the arms 161 pivot. The pins 170 are spring-loaded with suitable springs 175 that surround each of the pins. Each spring 175 is supported on its pin with a washer 171 that bears against the cross rod 176 and holds the spring in place. When the pins are installed in a table the springs 175 are trapped underneath the surface of the table panel 30.

Pivoting of the arms 161, and thus movement of the upper channel 163 (as well as the lower channel 164) is controlled through a pair of solenoids and a control lever. The control lever is indicated at 177, and is pivotally mounted on a pivot pin 179 fixed to a spacer 178 that is attached to the leg 152B of the angle 152. The lever 177 has a slot 179A that receives a drive pin 180 that is fixed to the channel 164, and the lower end of the lever 177 has a slot 181 which receives a pin 182, that is coupled to a link 183. The link 183 has its opposite ends pivotally connected to the actuators of a pin retraction solenoid 184, which is an AC driven solenoid, and a pin extension solenoid 185 that is at the opposite end of the link 183 from solenoid 184. The solenoid 185 will hold the gate pins 170 extended whenever the coin operated timers and the like are no longer effective.

Figure 11:
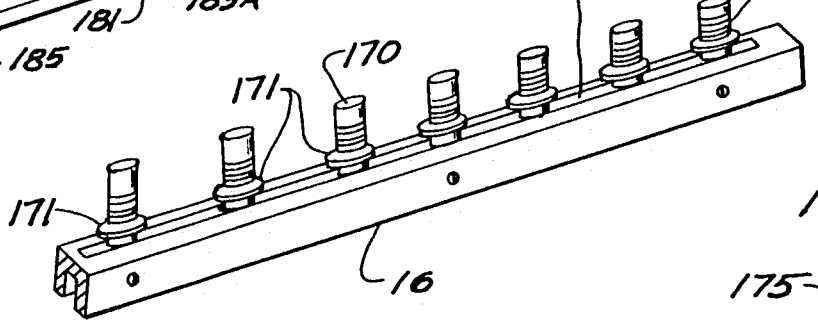
FIG. 11 is a perspective view of a series of gate pins used with the present invention, and shown mounted on the actuating portion used therewith.

A stop member 188 is provided at one end of the leg 152 to stop the movement of the channel 164 as the solenoid 184 pulls the lever 177 to a position to raise the gate pins 170. The end of channel 164 abuts against stop member 188 with the pins 170 in raised position. At the opposite end of the channel 164, there is a latching assembly 189 that will act to lock the channel 164 in its position with the pins raised. This includes a pivoting latch bar 190 that is mounted with a pivot block 191 onto a pivot stand 192, and is held so that the outer latch finger 193 which will engage the opposite end of the channel 164 from the stop 188 and can be moved from its locked position shown in FIG. 10, where it is held in place by a spring force from a spring 194 to a position wherein the finger 193 is retracted through the use of a solenoid 195 to clear the channel and permit the channel 164 to move to the right in FIG. 10, for example when the solenoid 185 is energized. FIG. 11 shows a more detailed perspective view of the latch pins, channel 163, and the mounting rod 176. FIG. 12 shows a detail of a pin 170 and mounting rod 176.

Figure 13:
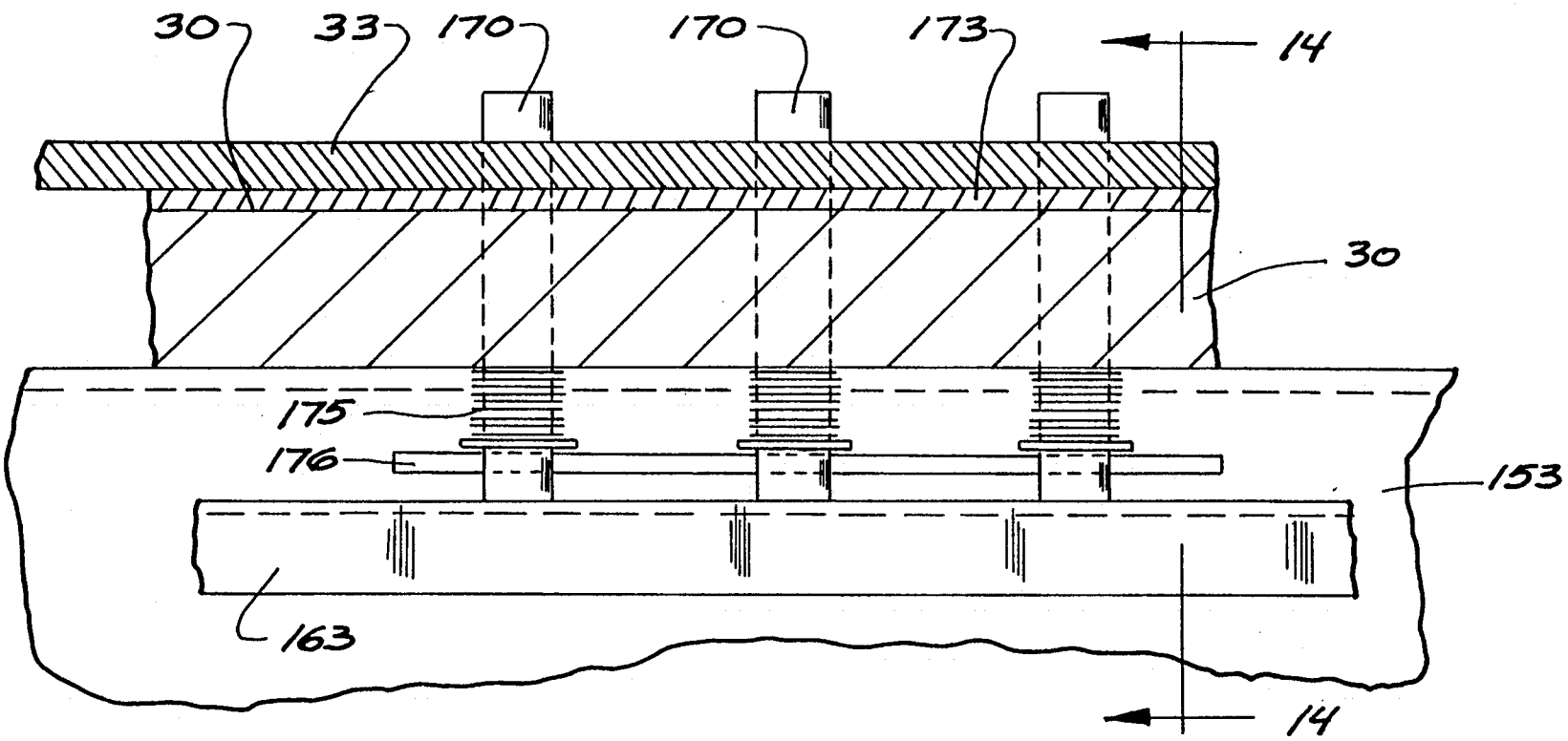
FIG. 13 is a fragmentary sectional view taken generally parallel to the longitudinal axis of the table of the present invention showing gate pins extending through the playing surface.

In FIG. 13, the gate pins are shown in raised position.

In FIG. 10, a switch assembly is shown at the end of the channel 163 above the latch assembly 189. The channel end is in position to contact an actuator finger 198 of the switch assembly that will be used for sensing when the gate pins are in the up position. The actuator finger 198 is used for in part controlling the sequence of operation. The finger 198 is pivotally mounted in a suitable manner so that it will move between two positions and carries switch contacts as shown in FIG. 18. FIG. 18 is a schematic representation of a typical gate pin control circuitry. In FIG. 18, the finger 198 is shown actually reversed from that in FIG. 10, so when the channel 163 is contacting it in the position shown in FIG. 18 and when the channel 163 moves away from finger 198, as the gate pins are lowered, it moves to the right, or is spring-loaded to the right in FIG. 18. With the gate pins raised, and the channel 163 holding the finger 198 in its illustrated position, switch contacts 199 are closed, and the spring loaded latching finger 193 is up or latched for holding the channel 164 in its solid line position.

If the coin input box 204 (FIG. 18) has received its coin, and the coin counter 205 indicates how much time is paid for, the 110-volt source, from lines 206 is then connected to the circuit and the correct timer or point switch is energized through output pins 205A. By depressing a start-game button shown at 207, power is provided to the AC solenoid through switch contacts 199, and a relay 195 is energized as shown to release the latch finger 193 by pivoting the latch bar 190 downwardly. Gate pin retractor solenoid 184, the AC solenoid, then pulls the link 183 to cause the channel slides 164 and 163 to move to the position as shown in FIG. 17, causing the springs 175 on the gate pins 170 to retract the gate pins 170 as the channel 163 moves away from table panel 30. The full stroke of the solenoid 183 is available for accomplishing this purpose, and as the channel 163 moves away from the switch finger 198. The spring loaded finger closes switch contacts shown at 209 and 210. The game then can be played because the gate pins 170 will be held in their retracted position through the action of the springs on the pins. The AC solenoid will be disenergized when the switch contacts 199 open, as will the latch solenoid 195. However, the travel is selected so that the latch finger 193 will be riding on the bottom of the channel 164, and there is no impetus to return the pins to their raised position to overcome the spring action on the pins. The latch finger is spring loaded so it will snap into latched position when the channel slide 164 again moves to raise the gate pins.

The game then can be played, until such time as the pin extension solenoid 185, which is a DC solenoid is energized.

As shown in FIG. 18, a pair of game point counters, including a counter 212 which is a fifteen-point counter and a counter 213, which is a twenty-one point counter will total the number of points, as recorded by pushing buttons, as shown in FIG. 2. An upcount button 214 is provided for one of the players, and an upcount button 215 is for another of the players. The number of points that are recorded can be controlled in a desired manner. Downcounts for minuses are recorded by buttons 216 and 217, respectively. These counts will be totaled much like on a calculator, with each impulse from the count buttons moving the counters 212 and 213 in a desired manner. In addition, there are timer switches that can be set to activate when the game start button 207 is pushed. The timer can be selected by suitable manual switches for the length of game desired, by the operator that has access to the circuitry and is tied in with the output pins 206A of the coin counter so a suitable time is energized. There is a timer 219, which is a ten-minute timer, or a timer 220. The timers 219 and 220 are connected in parallel, depending on the length that the game is to be run, just as one of the switches 212 and 213 may be selected by suitable switches for the number of point counts that are to be determined when play ends.

Assuming that one of the count switches closes, or one of the timer switches closes (only one of these switches will be used for a game), the circuit is then completed to the DC solenoid 185 through lines 221, which forms a ground connection, and line 222 which is connected to the positive side of a twelve-volt battery indicated at 223. The DC solenoid pulls the link 183 in direction to raise the pins 170 above the table surface. At the same time, a thirty-second time delay relay coil 224 is energized, and in addition a ten-second time delay coil 225 is energized.

If, after ten seconds the switch contacts 209 that are connected or actuated by the finger 198 do not open (they open when channel slide 163 has raised the gate pin), the time delay relay 225 will close contacts 225A to activate an alarm 226 which can be adjustable in volume and operate through a speaker 227 for an audible alarm, as well as lighting a light alarm 228. The time delay relay 225 latches on, after ten seconds as stated, to insure that the pins are not held down with something mechanical, without sounding some kind of alarm. After thirty seconds, the time delay relay 224 is operated to open contacts 224A, which disables the DC power to the DC solenoid 185, even if the contacts 209 are closed. This also shuts off the alarm amplifier and the ten-second time delay relay 225. The DC voltage is only temporarily interrupted, because the time delay relay 224 is also disabled, letting the contacts 224A close, again energizing the thirty-second time delay, the ten-second time delay and the solenoid, so that the alarm and speaker 227 and light 228 will continue to sound off intermittently, until the play restricting pins or gate pins 170 are allowed to come to their full up position where channel 163 can engage finger 198 and open the contacts 209.

A loss of power relay is indicated at 235. The contacts 236 for relay 235 are normally open when the power plug for the main AC power is inserted in the line. If the plug is pulled, the contacts 236 close and a twelve-volt supply is provided through the contacts 236, and contacts 210 (if the gate pins are retracted), and then through contacts 238, after a sixty-second time delay relay 239 has been energized by a twelve-volt source, namely battery 223. This will cause the time delay relay 224, and the ten-second time delay relay 225 to be energized and the alarm will continue to repeat until the AC power plug is again inserted into its power outlet to energize the relay 235 and again open contacts 236.

The twelve-volt battery 223 is kept in full charge with a charger 240 that is also powered whenever the power plug is connected, so that the DC power will be adequate to sound the alarms as necessary.

A master switch 242 is provided for the key operated lock to shut down the alarm system if the gate pins 170 have been physically damaged and repairs have to be made.

The count actuating buttons 214, 215, 216 and 217 also control displays on the display panel indicated at 250 in FIG. 1, in a suitable manner. The wiring is contained in a channel shown at 252 in the central dividing rail 55, as shown in FIG. 7. The connections to the indicator lights are shown at 213A and 213B, and 212A and 212B, respectively. The same kind of connections are used for the timers to provide the time remaining indication on the display board. This is done in a conventional manner.

The lines for time indication signals are shown at 219A, 219B, and 220A and 220B.

Thus, the game not only is laid out in a unique manner to provide for a divided court shuffleboard, with a uniqued scoring pattern adjacent the base ends, and with unique bumper arrangements that can be replaced easily and quickly, but also has a coin operated arrangement that provides gate pins in one series, that are reliably and quickly operated, and which can be controlled as desired to achieve the necessary anti-theft or anti-vandal action.

Figure 19:
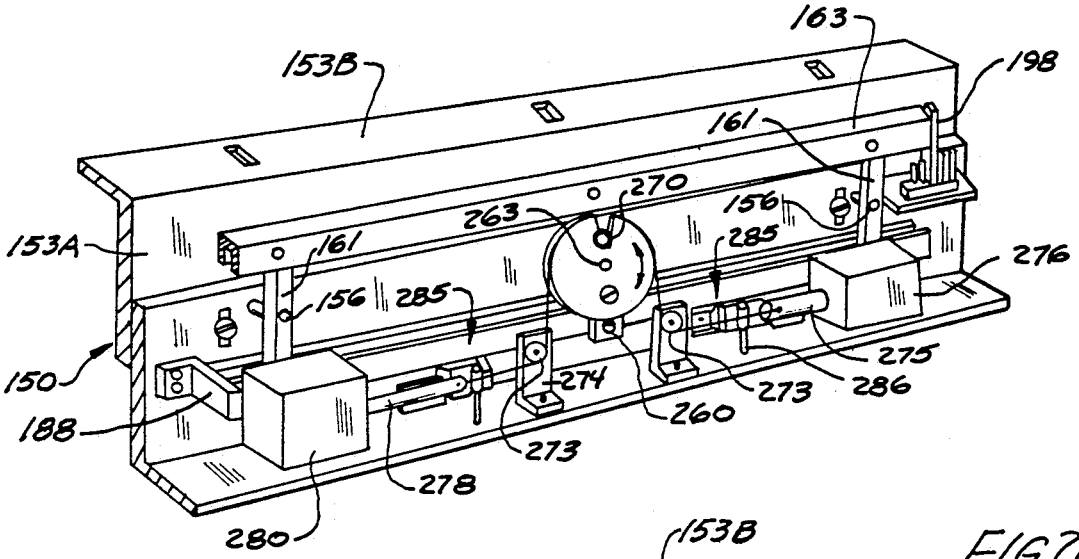
FIG. 19 is a perspective view taken substantially similar to FIG. 1 showing a modified form of a gate pin actuating assembly.
Figure 20:
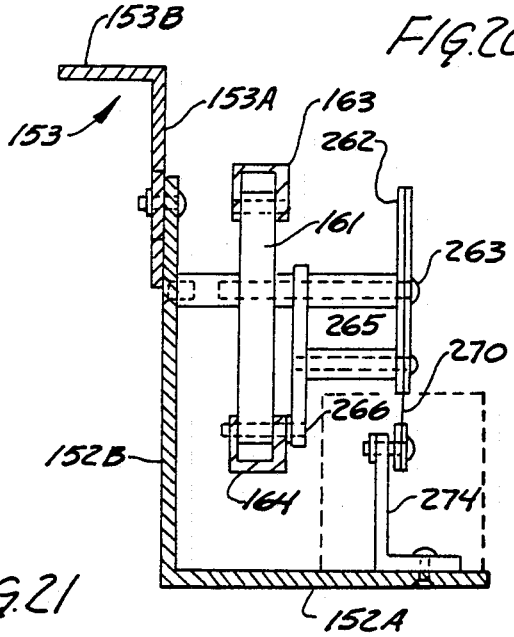
FIG. 20 is a transverse sectional view showing a cross section of the gate pin operation of FIG. 19.
Figure 21:
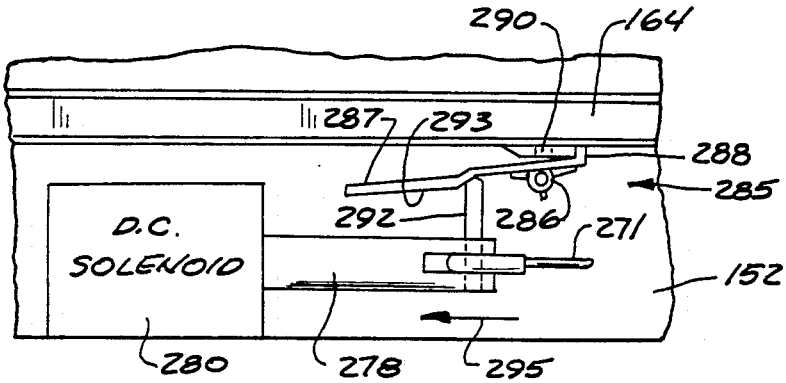
FIG. 21 is a top plan view of a latch mechanism utilized with the device of FIG. 19.

In the second form of the gate pin actuating assembly shown in FIGS. 19, 20, and 21, the gate pins 170, the coupling rod 176 and springs 175 are arranged as before. The springs 175 act against the underside of the table surface to urge the gate pins to retract. The support frame 150 is also the same as that shown before, and includes a first angle iron 152, and the second angle iron 153. The base leg 152A of the angle iron 152 is oriented as before, and has an upright leg 152B that mates with a leg 153A of angle iron 153. The leg 153B clamps to the table top panel as shown before. These frame members are fastened together, and are adjustable as previously explained. Additionally, the gate pins 170 are supported on a support channel or slide bar 163 in the same manner as before. The channel 163 is mounted on pivoting arms 161 through pivot pins 156 at opposite ends thereof. The pivot pin for the center or middle arm 161 is elongated as will be shown. The lower ends of the arms 161 support a channel or slide bar 164 on suitable pivot pins 165. Thus, the channels 163 and 164 will move in opposite directions because of the pivoting of the arms 161. A stop member 188 is provided at the left end of the angle iron 152 to limit movement of channel 164. In this form of the invention, the gate pin actuation is with an actuating mechanism illustrated at 260. This actuating mechanism still includes solenoids, that operate to provide forces in opposite directions. The control preferably includes a micro-processor that can be programmed to provide time lapse.

A pulley 262 is rotatably mounted on a central pivot pin 263 which also mounts the center one of the arms 161. A crank pin 264 is drivably mounted to the pulley 262, at a location spaced from the axis of the pivot pin 263. As can be seen in FIG. 20, the pin 264 is drivably connected to a crank 265 that is also rotatably mounted on pin 263 and has an outer end drivably connected with a pin 266 to the same pin that pivotally mounts the center arm 161 to the lower channel 164. This can be seen in FIG. 20, and the pin 266 can also be seen in FIG. 19.

The pulley 262 has an anchoring notch 270 therein which has a suitable anchor pin or bolt fixed therein for holding a flexible cable or other flexible, elongated driving element 271 in position. The flexible driving element 271 in turn is mounted over portions of the periphery of the pulley 262 and has end portions guided over guide pulleys 273, 273 that are mounted on upright supports 274 that are in turn fixed to the leg 152A of the angle iron 152. A first length of the cable or drive element 271 is drivably connected to a plunger or actuator 275 of a first DC solenoid 276 that is mounted onto the leg 152A of the angle iron 152. The opposite length of the cable or drive element 271 is drivably connected to a second plunger 278 of a second DC solenoid 280 that also is mounted on leg 152A of the angle iron 152.

As the respective solenoids are operated, they will cause the arms 161 to pivot by driving pulley 262 through the crank pin 264 and the crank arm 265, to slide the lower channel 164 in opposite directions. This will cause the upper channel 163 to move between the positions shown in the first form of the invention, under control of the different type of drive utilizing two DC solenoids 276 and 280. A switch assembly finger 198 is controlled as before, and the circuitry can be slightly different because of the use of DC solenoids, which are operated to move the pulley in both directions of operation.

In order to provide latches for the lower channel 164, a spring-loaded latch assembly indicated generally at 285 is provided for each of the solenoids, and a typical one is shown in FIG. 21. These latches are released when the respective solenoid is operated so that the lower channel 164 is held positively in its positions at the ends of its stroke, and then can be released when the respective solenoid is operated.

As shown for each latch, an upright pivot pin 286 is mounted on the leg 152A of the angle iron 152, and pivotally mounts a latch lever 287 that has a latch finger end 288 that hooks over a detent block 290. The detent block 290 has a ramp surface 291 at the opposite end of the block from the latching surface against which the latch finger 288 is resting as shown in FIG. 21. A torsion spring 292 is used for urging the latch finger 288 against the side surface of the channel 164.

The plunger 278 of the solenoid 280, which is shown in FIG. 21, has a pin 292 mounted thereon engaging a ramp surface 293 of the actuator latch lever 286, so that when the plunger 287 is moved to retract, as indicated by the arrow 295, it will ramp up and release the latch finger 288 while applying load to the cable 271, to permit the channel 164 to be released and to move. This type of a latch is used on both ends of the channel 164 to hold the channel in position.

Figure 22:
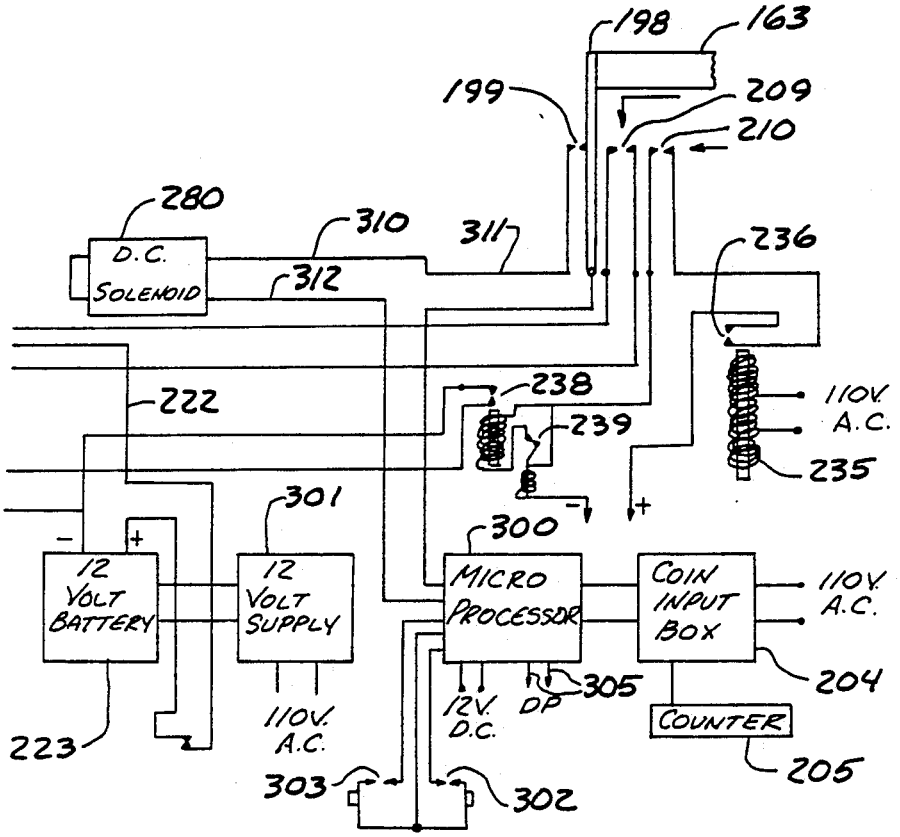
FIG. 22 is a schematic representation of a circuit modification used with the form of operation shown in FIGS. 19-21.

FIG. 22 shows a simplified revision of the circuit of FIG. 18, for use with the DC solenoids. The same numbers are applied to the same elements that are shown in the previous figure, and in this form of the invention the coin input box 204 is connected to a microprocessor 300 which is connected to a source of 12 volt DC from a 12 volt supply 301 which can be used also as a charger as in the first form of the invention for charging the 12 volt battery 223. The solenoid 280, which is a DC solenoid, is shown schematically, and is powered from a source of DC voltage from the microprocessor that will be energized when either a two-player button 302 is pushed, or a four-player button 303 is pushed to tell the microprocessor what logic controls should be provided to the various timers from output pins 305 on the microprocessor. The solenoid 280 is connected with a line 310 to the contacts 199 which in turn are connected to the microprocessor through a line 311, and the other side of the solenoid 280 is connected to a line 312 to the microprocessor to be energized when the appropriate play buttons 302 and 303 are depressed. The microprocessor provides the logic controls to the various components that are shown in the previous form of the circuitry, and the other game point and time delay switches, the time delay relays 224 and 225 and the other D.C. solenoid are operated in exactly the same way as previously explained. The solenoid 185, however, is replaced with the solenoid 276, for lowering the gate pins.

Figure 23:
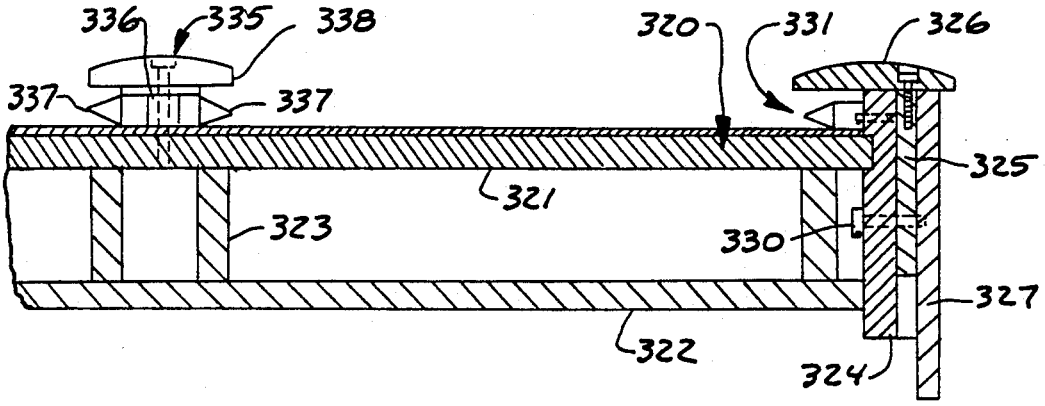
FIG. 23 is a fragmentary cross-sectional view of a portion of the table showing a modified construction.

FIG. 23 illustrates a simplified manner of constructing the side panels and top rails of the present invention, which can be bolted from the top. As shown, a table top 320 will be constructed as previously explained, and includes a top board 321, and bottom cross members 322 that can be a continuous piece or spaced as desired, along with vertical spacers 323 that provide for support for the system.

In this form of the invention, a side board 324 can be fastened onto the table top 321 and the bottom board 322 in a suitable manner, and a spacer board 325 can then be placed on the outside of this. The spacer board is used for supporting a top cap 326 with bolts coming in from the top that can be attached directly to the spacer board 325, so the top cap can be removed easily. An outer decorative facia board 327 can then be bolted or otherwise fastened from the interior of the table top using suitable bolts or fasteners 330.

A rubber bumper assembly 331 can be made in the same manner as before, and replaced as a single block or unit, but as shown it can have a slightly different shape.

For the center rail assembly 335, a support block 336 is provided for supporting the bumper assembly 337 on opposite sides thereof, and the top cap for the central divider, indicated at 338 can be bolted from the top as desired into the support block 336, and into the table top 321.

The blocks 337 can be replaced as units as before, in the receptacles formed by the overhanging lips of the top cap 338 in the center divider, as well as the overhanging portion of the top cap 326 on the edge. This type of construction can be modified as desired for ease of assembly and manufacture Thus, modifications of the supports can be made, and also modifications in the circuitry can be accomodated with the present invention It should be noted that the bolts for holding the side panels in place can be positioned between the transverse stringers that are provided on the table, and that the members 323, which are shown extending in longitudinal direction are used only at the end where the puck pit is provided.

Although the present invention has been described with reference to preferred embodiments, workers skilled in the art will recognize that changes may be made in form and detail without departing from the spirit and scope of the invention.

What is claimed is:

1. A shuffleboard game comprising a rectangular table having first and second opposite ends, and opposite sides joining said ends to define a playing surface, the sides and opposite ends comprising side and end walls extending upwardly from the playing surface, a central, narrow elongated divider substantially midway between the sides and extending from adjacent said first end, adjacent which a player stands to a position spaced from said second end, said divider extending for a length substantially greater than one-half of the length of the side walls, and cushion means on opposite sides of the divider and on the side and end walls being capable of rebounding a sliding game piece that is slid along the table surface by a player, the divider having sides parallel to each other and to the side walls, and the end walls being substantially perpendicular to the length of the divider said playing surface comprising a smooth top surface for supporting a sliding game piece, a scoring region visible on said top surface comprising scoring patterns defined at said surface only adjacent said first end thereof, said scoring patterns, having high scoring and lower scoring areas on each side of said center divider at said first end, said scoring areas extending a selected distance from said first end and toward said second end, and across said surface between said center divider and the sides of the playing surface, and a game piece pit recessed below said playing surface and extending across the table between the side walls and being positioned between the end wall at said first end and said scoring region.

2. The apparatus as specified in claim 1 wherein said cushion means comprises a resilient member protruding toward the playing surface, on each of the side and end walls of the playing surface, and along the divider, and a support block for said cushion member, receptacle means formed on said divider, and on said side and end walls for receiving said support block, and means for locking said support block in place in the receptacle means.

3. The apparatus as specified in claim 2 wherein said resilient member and said support block are covered with a flexible material to hold them in an assembly.

4. A shuffle board game as claimed in claim 1, wherein the table comprises a cover having the playing surface thereon, said cover being formed of a transparent plastic, and having lines defining the scoring regions in desired patterns on a bottom surface thereof, said bottom surface being the surface of said transparent plastic opposite form the playing surface, and which scoring regions can be seen through the plastic cover form above the playing surface.

5. A shuffleboard table having a playing surface, said table having opposite side walls and first and second end walls and a narrow divider member on the playing surface that extends from a player end at said first end wall of the table and toward said second end wall, said divider extending from said first end wall and terminating at an outer end a distance from said second end wall sufficient to permit passing of a sliding game piece from one side of said divider member to said other, said divider member dividing said playing surface into separate courts between said side walls scoring means at said player end of each of said courts, and cushion members on said sides of said table, and on sides of said divider member for permitting a sliding game piece to be rebounded form one court to the other when it is started sliding from the respective player end, upon rebounding on cushions at said second end of the table, said divider having straight, parallel sides extending along the length thereof, said scoring means being defined by a plurality of irregularly patterned high scoring areas and low scoring areas extending between said divider member and each side of the respective court, said high scoring area being a separate region or said playing surface adjacent said player end on said opposite sides of the divider and being the smaller of said plurality of scoring areas and extending partially across the player end toward the respective sides and side second end and said lower scoring areas being of successively lower value scoring regions extending from said respective higher scoring areas towards said second end and the respective sides of said playing surface on each side of the divider member.

6. The apparatus as specified in claim 5 and gate pin means substantially bisecting said table surface in a location between said outer end of said divider member and said second end of said playing surface, said gate pin means comprising a plurality of pins that are slidably mounted with respect to said table surface for movement between a position protruding above the table surface and a position below said table surface, actuator means for said gate pin means responsive to preselected operating signals, said actuator means including means for latching said gate pins in a position protruding above said table surface.

7. The apparatus as specified in claim 6 wherein said gate pins are biased in a direction to move them to position below said table surface.

8. The apparatus as specified in claim 6 wherein said actuating means includes a slide bar assembly supporting said pins, said slide bar assembly being movable longitudinally along said axis of said divider while said pins slide thereon, said latch measn being operable to prevent said slide bar assembly form moving in a second direction when said slide bar assembly has moved in a first direction a desired amount, until said latch member is released by external forces.

9. A shuffleboard table having a playing surface defined by sides and ends, a divider member on the playing surface that has a longitudinal axis and which extends longitudinally from a player end of the board toward an opposite end, and which has an outer end terminated from the opposite end of the playing surface a distance sufficient to permit passing of a sliding game piece from one side of the divider member to the other side thereof, said divider member dividing the playing surface into separate courts, scoring means at the player ends of each of said courts, and cushion members on the sides of the table, and on said divider member for permitting a sliding game piece to be rebounded from one court to the other when it is started sliding form the respective player end, upon rebounding on cushions adjacent the opposite end, a gate substantially bisecting the table surface between the outer end of the divider member and the opposite end of the playing surface, said gate comprising a gate of pins that are slidably mounted with respect to the table surface for movement between a position protruding above the table surface and a position below the table surface, an actuator for said gate responsive to preselected operating signals, said actuator including a latch to hold the gate pins in position protruding above the table surface, said actuator further including a slide bar assembly slidably mounted below the table surface, said slide bar assembly being movable longitudinally in a first direction along the longitudinal axis of the divider, said latch being operable to prevent said slide bar assembly from moving in a second direction when the slide bar assembly has moved in a first direction a desired amount, until said latch is released, said slide bar assembly comprising a pair of generally parallel upper and lower slide bars having slide for longitudinal axes, and pivoting arms connected between said slide bars, said pivoting arms being pivoted at the slide bar opposite ends to said slide bars to hold said slide bars in spaced apart position, the arms being pivotally mounted with respect to said table, whereby pivoting of the arms causes the slide bars to move along their longitudinal axes and cause an upper one of said slide bars to move in a direction toward and away form the table surface, said gate pins being actuated by said upper slide bar to cause one of said pivoting arms to pivot and change the elevation of an upper slide bar and the gate pins relative to the playing surface.

10. The apparatus as specified in claim 9 and a switch mounted for sensing the position of said upper slide bar, said switch controlling operation of the actuator only when the upper slide bar is in a desired position.

11. The apparatus as specified in claim 9 and solenoid means to selectively move said slide bars in opposite directions for actuation between the position with the gate pins above the table surface, and with pins below the table surface.

12. The apparatus as specified in claim 9, wherein the actuator comprises solenoid means for selectively moving said slide bars in opposite directions for actuation between the positions with the gate pins above the table surface, and with the gate pins below the table surface, the actuator further comprising a rotatable pulley mounted on an axis of pivotal movement of one of the arms, a flexible elongated member mounted over said pulley and extending in opposite lateral directions therefrom, said solenoid means comprising two solenoids actuable in opposite directions to create tension forces in opposite directions on said flexible member to tend to selectively rotate said pulley, and crank means connected between said pulley and at least one of said pivoting arms to cause one of said pivoting arms to pivot when the pulley is rotated to thereby move the slide bars in opposite directions and change the elevation thereof relative to the playing surface.

13. A shuffleboard game comprising a rectangular table having opposite ends, and opposite sides joining said ends to define a playing surface, the sides and opposite ends comprising side and end walls extending upwardly from the playing surface, a central, narrow elongated divider substantially midway between the sides and extending from adjacent a first player end, adjacent which a player stands to a position spaced from a second opposite end, said divider extending for a length substantially greater than one-half of the length of the side walls, and cushion means on opposite sides of the divider and on the side and end walls, being capable of rebounding a game piece used for sliding along the table surface, the divider having sides parallel to each other and to the side walls, and the end walls being substantially perpendicular to the length of the divider, said playing surface comprising a smooth top surface, and scoring patterns defined on said surface only adjacent the player end thereof, said scoring patterns having a high score rectangular scoring area adjacent the center divider, and on each side thereof at the one player end, said rectangular scoring areas extending only a small distance from the divider toward the sides of the playing surface, and a series of sequentially lower score areas forming L-shaped strips having the same score that have portions parallel to the sides and ends of the playing surface, the portions parallel to the sides being between the rectangular scoring areas and the respective sides, with the lowest scoring strips being adjacent the opposite sides of the playing surface, and including a negative score adjacent the center divider and spaced from the player end the greatest amount in the scoring direction.

* * * * *

UNITED STATES PATENT AND TRADEMARK OFFICE

CERTIFICATE OF CORRECTION

PATENT NO. : 5,011,147

DATED : April 30, 1991

INVENTOR(S) : Dale A. Thomas et al.

It is certified that error appears in the above-identified patent and that said Letters Patent is hereby corrected as shown below:

Col. 14, line 55, delete "or", insert --on--.

Col. 14, line 61, delete "regions", insert --region--.

Col. 15, line 13, after "assembly", insert --directly--.

Col. 15, line 16, delete "measn", insert --means--.

Col. 15, line 17, delete "form", insert --from--.

Col. 15, line 34, delete "form", insert --from--.

Col. 16, line 22, delete "actuable", insert --actuatable--.

Signed and Sealed this

Sixth Day of October, 1992

*Attest:*

DOUGLAS B. COMER

*Attesting Officer*

*Acting Commissioner of Patents and Trademarks*